US006152061A

United States Patent [19]

Perez-Collazo

[11] Patent Number: 6,152,061

[45] Date of Patent: Nov. 28, 2000

[54] FLOATING COLLAPSIBLE HULL PROTECTOR AGAINST MARINE GROWTH

[76] Inventor: Eduardo Perez-Collazo, Cond. Villas del Mar Oeste, Apt. 2-I, Isla Verde, Puerto Rico 00979

[21] Appl. No.: 09/357,414

[22] Filed: Jul. 20, 1999

[51] Int. Cl.[7] ..... B63B 59/00

[52] U.S. Cl. ..... 114/222; 114/230

[58] Field of Search ..... 114/45, 222, 230, 114/221 R, 361; 405/63–68

[56] References Cited

U.S. PATENT DOCUMENTS

| | | | |
|---|---|---|---|
| 3,205,851 | 9/1965 | Wiswell, Jr. | 114/222 |
| 3,685,477 | 8/1972 | Wood | 114/222 |
| 5,549,069 | 8/1996 | Faidi | 114/222 |

*Primary Examiner*—Jesus D. Sotelo

*Attorney, Agent, or Firm*—Donald W. Meeker

[57] ABSTRACT

A water-impervious material forms a protective envelope around the hull of a vessel. Interconnected pipe sections in a tubular opening around the upper edge of the envelope form a rigid frame to maintain the shape of the envelope. A pair of split rods pivotally connected at two points between pipe sections create a front collapsible portion of the envelope. The weight of the pipe sections in the front collapsible portion cause it to sink and pivot downwardly to allow a vessel to enter and exit the envelope. Ropes and blocks between the front portion and the floating piers are used to raise the front collapsible portion and the ropes tied to the vessel to maintain the front portion in place. The remainder of the envelope is fitted with a series of floats so that the envelope encircles the vessel to prevent marine growth on the hull of the vessel. Counterweights on ropes through pier blocks and connected to the envelope around its perimeter maintain it in place around the vessel.

14 Claims, 2 Drawing Sheets

FLOATING COLLAPSIBLE HULL PROTECTOR AGAINST MARINE GROWTH

BACKGROUND OF THE INVENTION

1. Field of the Invention

This invention relates to underwater body protectors against marine growth on boat hulls and more particularly to a floating collapsible hull protector against marine growth for encircling the underwater body of a vessel moored in a slip with easy access through a collapsing front of the hull protector.

2. Description of the Prior Art

Protectors against marine growth in the form of water impervious envelopes complementary to the underwater shape of a vessel are known. Such envelopes after being positioned around the under body of the vessel are then filled with growth inhibiting liquids which may be only fresh water or water containing anti-fouling chemicals. The problem with such envelopes is that they are difficult to maneuver around the vessel's under body and various schemes have been resorted to ease this task but no one system has been more efficacious than another and all have been burdensome.

The applicant's U.S. Pat. No. 5,279,244 provides an underwater body protector which completely drops down to permit the boat to enter and exit the slip, enabling the boat to maneuver more easily than other prior art systems. A rope and pulley system is used to hoist the protector into place around the boat where the protector is tied to cleats around the perimeter of the boat. While this device provides advantages over other prior art, it does require hauling up the entire protector and attaching it to the boat, which can be tiring and time-consuming, especially for a large boat.

SUMMARY OF THE INVENTION

An object of the present invention is to provide a floating boat hull anti-fouling protector which is wider and deeper than the boat hull, so that the protector may float in place in the boat slip and permit the boat to moor and embark easily moving in and out of the protector.

Another object of the present invention is to provide a collapsible front on the floating boat hull protector to enable the boat to enter and exit the protector easily by lowering the front only and to enable the front to be lifted up into place after the boat is in the protector so that the protector completely encircles the boat and protects the boat hull from marine growth.

One more object of the present invention a boat hull protector with a water impervious shell surrounding the hull when the boat rests in the slip thereby preventing nutrients and oxygen suspended in the water from reaching the barnacles and weeds that cling to the hull so that the barnacles and weeds die off and fall from the hull.

An additional object of the present invention is to provide a frame around the top of the hull protector formed of aluminum pipes or other stiff rust-proof members inserted in a tubular opening around the top perimeter of the hull protector to enable the hull protector to maintain its shape with ample room for the boat to move in and out of the hull protector.

A further object of the present invention is to provide floats, such as foam blocks or other floatation devices around the perimeter of the hull protector to enable the hull protector to float with the top perimeter of the boat protector exposed above the water line to prevent additional water from entering the hull protector once the front is raised in place.

A contributory object of the present invention is to provide lines running from the perimeter of the hull protector over pulleys, or blocks, attached to the pier with a counterweight at the end of each line to hold the hull protector in position in the middle of the slip so that the boat can enter and exit easily.

A further object of the present invention is to provide a hull protector formed of a waterproof material which is bacterial and fungal corrosion resistant, such as Pro-Liner 40® manufactured by Marseal Corrosion Resistant Linings so that the hull protector requires no maintenance.

In brief, a waterproof corrosion resistant sheet of material is formed into a hull-shaped configuration larger than the hull for which it is intended to form a water impervious flexible envelope surrounding the hull spaced away from the hull by approximately two feet. Floatation devices, such as foam floats, attached around the perimeter of the hull protector maintain the top edge of the hull protector above the waterline regardless of the tide conditions, since the hull protector floats so that it always surrounds the boat when it is in the slip.

Aluminum pipes, or other rust-proof rigid elongated members, are inserted in a tubular sleeve around the top perimeter of the sheet material forming a rigid top peripheral frame to retain the shape of the hull protector. A hinge formed by a pivotal connection, such as a pin or bolt through a split rod with overlapping ends, between two adjacent overlapping aluminum pipe sections on each side of the boat near the front of the hull protector enables a front section of the hull protector to collapse downwardly as the front section of the pipe frame pivots downwardly, thereby leaving the front of the hull protector open for the boat to enter and exit the envelope formed by the hull protector.

After the boat is in place within the hull protector, lifting the front section of the hull protector, by means lines attached to blocks on the front section and on the pier, and securing the front section in place by securing the lines to the boat, thereby encloses the boat hull within the hull protector. After being thus positioned the hull protector prevents nutrients and oxygen in the surrounding water from reaching the water within the envelope adjacent to the boat so that any weeds or barnacles which attach to the hull will die and fall off.

Lines from the hull protector extend over pulleys, or blocks, attached to the dock or pilings with a counterweight at the end of each line to hold the hull protector in place in the middle of the slip.

An advantage of the present invention is that it can be operated easier and faster than other devices requiring only the raising and lowering of the front collapsible portion rather than the entire hull protector.

Another advantage of the present invention is that it saves the boat owner a considerable amount of time and effort and cost that would normally be spent in hauling the boat out of the water and scraping the hull, as well as providing extra use time for the boat since it can remain in the water all the time.

An additional advantage of the present invention is that the hull protector also serves to protect the hull from floating objects and moderately rough waves which might otherwise batter the hull in the slip.

Still a further advantage of the present invention is that the hull protector will also help to control and reduce electrolysis which is very harmful to boats.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
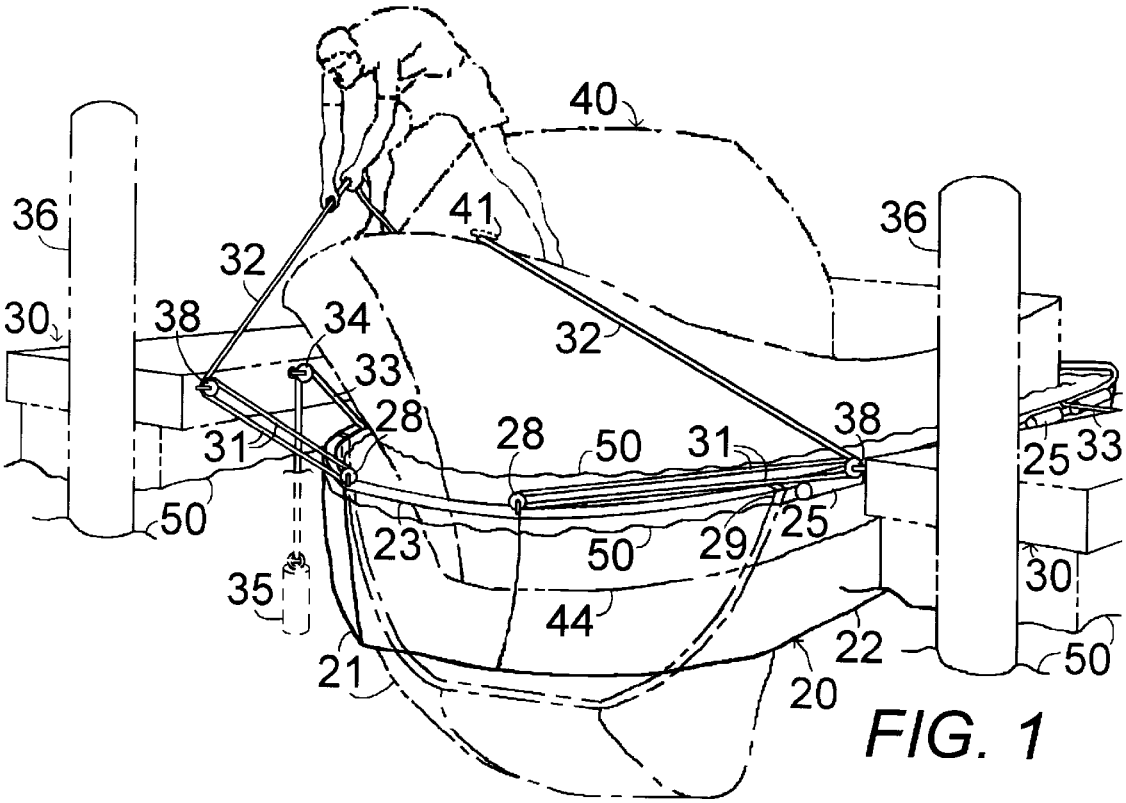
FIG. 1 is a perspective view of a boat within the hull protector in the slip, and also showing (in dashed lines) the lowered collapsed position of the collapsible front of the hull protector.

In FIGS. 1, 2, 4, and 5, a protector against marine growth for an underwater body of a vessel 40 when moored in a body of water 50 within the protector, which may be positioned within a slip having floating piers 30 and pilings 36, comprises an envelope 20 of corrosion-resistant water impervious material secured to the slip. The material is preferably a black bacterial, fungal resistant waterproof lining called Pro-liner 40®, manufactured by Marseal Corrosion Resistant Linings. The envelope 20 has an outer end facing out of the slip and an inner end facing into the slip and an upper edge 23 at the waterline 50 surrounding the vessel 40, the envelope 20 being of a size and shape complementary to the underwater part of a vessel's hull from its bow to its stem and from its keel to a position between its water line and its deck.

Figure 6:
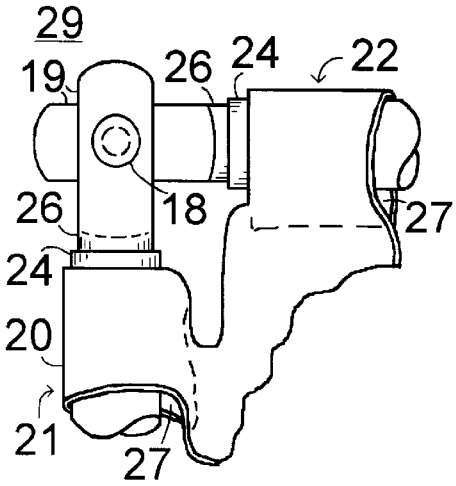
FIG. 6 is a partial side elevational view showing the pivotable joint which joins the collapsible front to the rest of the hull protector with the collapsible front pivoted down in the collapsed position and the joint bent at 90°.
Figure 7:
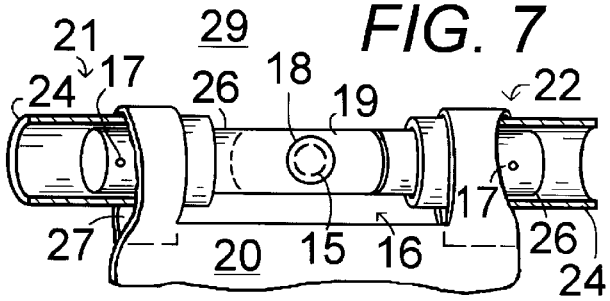
FIG. 7 is a partial side elevational view in partial section showing the elements of the pivotable joint connected to the pipe sections forming the rigid support around the upper edge of the hull protector with the collapsible front up and the joint straight.
Figure 8:
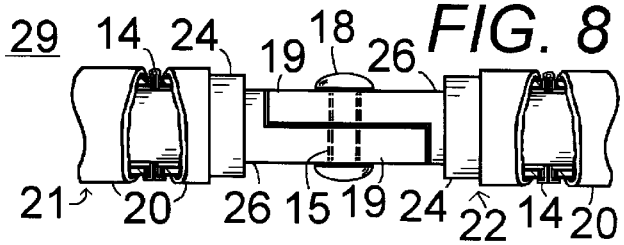
FIG. 8 is a partial top plan view in partial section showing the elements of the pivotable joint of FIG. 7.

The outer end has a collapsible front portion 21 connected by a hinge means 29 to a remaining portion 22 of the envelope. A rigid elongated element secured around the upper edge 23 of the envelope maintains the upper edge in a rigid shape. The envelope 20 is fabricated of a flexible sheet of water impervious material having a tubular opening 27, as seen in FIGS. 6–8, around the upper edge and the elongated element comprises a series of interconnected pipe sections 24 fabricated of a rigid waterproof material such as aluminum pipe, the pipe sections being inserted and interconnected inside the tubular opening around the entire perimeter of the envelope 20 to act as a frame to hold the shape of the envelope 20. The pipe sections 24 in the collapsible front portion of the envelope having sufficient weight to form a weighted means to sink the collapsible front portion in water.

The remaining portion 22 has a buoyant means of buoying up the remaining portion in the body of water comprising a series of floatation devices 25, such as foam (Styrofoam®) floats, secured by tying or other conventional means at intervals around the upper edge of the remaining portion of the envelope.

Figure 2:
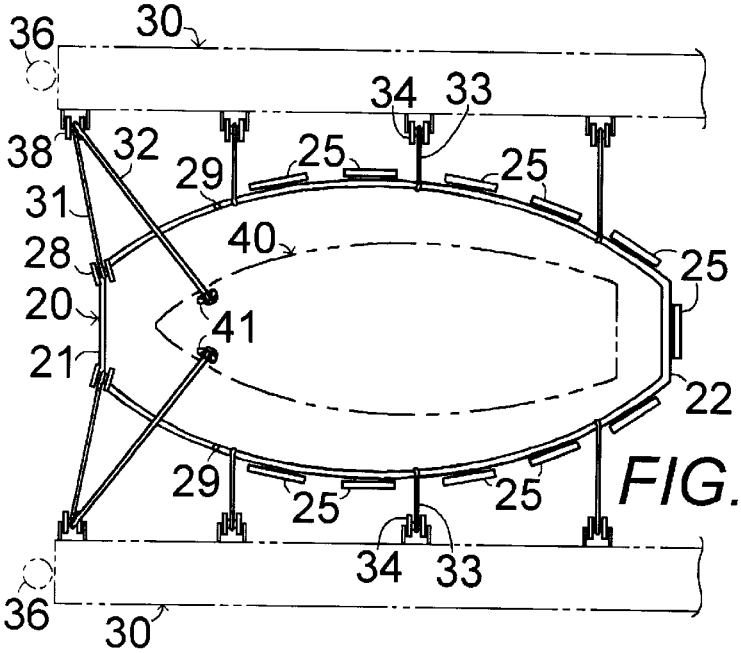
FIG. 2 is a plan view showing the hull protector with the collapsible front of the hull protector in its raised position about a vessel in the slip.
Figure 5:
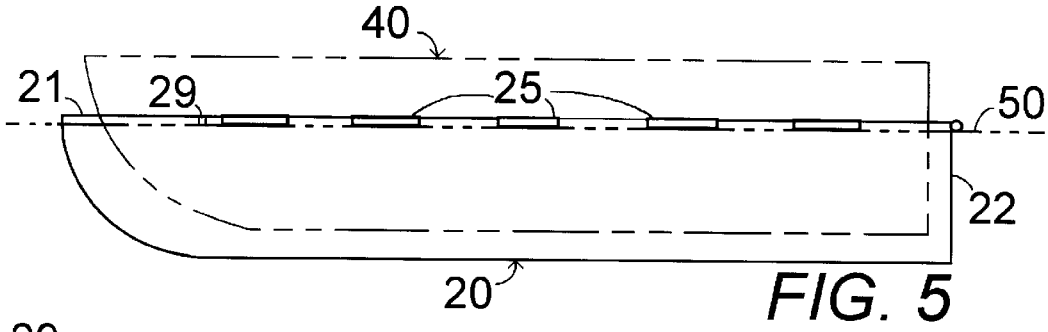
FIG. 5 is a side elevational, somewhat schematic view showing the hull protector in place on a vessel with the collapsible front raised.

A means for hoisting the collapsible front portion 21 and a means for maintaining the collapsible front portion at the water level comprises at least one protector block 28, or pulley, attached to the collapsible front portion 21 and at least one pier block 38, or pulley, attached to the pier 30 and a rope 31 capable of being secured removably through the blocks and pulled on a hoisting portion 32 of the rope for hoisting the collapsible front portion 21, the rope further capable of being secured to the vessel 40 by tying to a cleat 41 for maintaining the collapsible front portion 21 at the water level 50 surrounding the vessel, as seen in the solid line view of the collapsible front portion 21 in FIG. 1 and in FIGS. 2 and 5. Preferably a pair of protector blocks 28 are used, with one of each of the pair connecting to a pier block 38 on a pier 30 on each side of the vessel, as seen in FIGS. 1 and 2.

The collapsible portion 21 is alternately capable of sinking, pivoting downwardly at the hinge means 29, to allow the vessel to enter and exit the envelope, as seen in FIGS. 1 (wherein the downwardly pivoted front portion 21 is shown dashed) and 4, and alternately capable of being raised up to the water level by the means for hoisting and maintained at the water level by the means for retaining the collapsible front portion so that the envelope surrounds the vessel and protects the vessel from marine growth, as seen in FIGS. 1 (solid line version of collapsible front end 21), 2, and 5.

In FIGS. 6–8, the hinge means comprises a hinge connection 29 between a section of pipe 24 in the collapsible front portion 21 of the envelope and a section of pipe 24 in the remaining portion of the envelope 22 at a cut-out portion 16 of the envelope 20. A split section formed of a solid aluminum rod 26 each inserted in the adjacent section of pipe 24 within the tubular opening 27 of the envelope 20 and connected thereto by a pin means, such as cotter pins 14 through holes 17 in the rod. Each rod 26 has one of a pair a protruding joint sections 19 which overlap and are pivotally pinned together through circular openings 15 in the joint sections by a pin means 18, such as a stainless steel pin or bolt or rivet smaller in diameter than the circular openings, to form a pivotable hinge connection 29.

Figure 3:
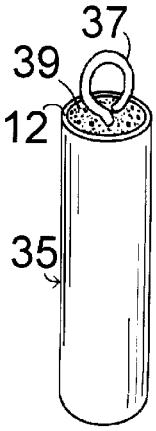
FIG. 3 is a perspective view of a counterbalance weight for the present invention.
Figure 4:
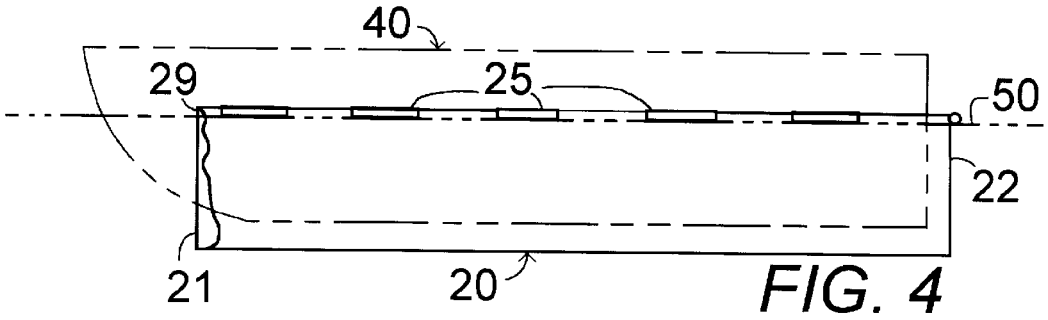
FIG. 4 is a side elevational, somewhat schematic view showing the hull protector in place on a vessel with the collapsible front lowered.

As seen in FIGS. 1 and 2, a means for securing the envelope to the slip comprises a series of blocks 34, or pulleys, secured to the piers 30 of the slip at various points and a series of ropes 33 threaded through the blocks 34, each of the ropes secured at a proximal end to one of a number of points around the remaining portion of the envelope 20 opposite to a block and secured at a distal end to a weight 35, or counterweight, submerged in the water pulling the rope 33 tight, so that the envelope 20 is retained within the slip and the upper edge 23 of the envelope is pulled outwardly away from the vessel 40, preferably about two feet from the vessel. In FIG. 3 the preferred embodiment of the weight 35 is formed of a section of pipe 12 filled with concrete 39 and having a top loop 37 to which the rope 33 is secured.

In operation, the collapsible front portion 21 of the envelope 20 is lowered to admit the vessel inside the envelope 20, which is slightly larger than the vessel for ease of entry. The boat is tied to the piers 30 in a conventional manner to secure it within the envelope. The front collapsible portion 21 is raised and secured around the front of the vessel using ropes 31 and 32 and blocks 28 and 38. The water impervious shell provided by the envelope 20 surrounding the hull when the boat rests in the slip prevents nutrients and oxygen suspended in the water from reaching the barnacles and weeds that cling to the hull so that the barnacles and weeds die off and fall from the hull. Lowering the collapsible front portion 21 allows the vessel to exit the envelope 20.

The size of the envelope 20 and the number of floats 25, blocks 34 and ropes 33 and counterweights 35 depend upon the size of the vessel.

It is understood that the preceding description is given merely by way of illustration and not in limitation of the invention and that various modifications may be made thereto without departing from the spirit of the invention as claimed.

What is claimed is:

1. A protector against marine growth for an underwater body of a vessel when moored in a body of water within the protector which may be positioned within a slip having a pier and pilings, the protector comprising:

an envelope of water impervious material secured to the slip, the envelope having an outer end facing out of the slip and an inner end facing into the slip and an upper edge at the waterline surrounding the vessel, the envelope being of a size and shape complementary to the underwater part of a vessels hull from its bow to its stern and from its keel to a position between its water line and its deck, the outer end having a collapsible front portion connected by a hinge means to a remaining portion of the envelope, the collapsible front portion having a weighted means for sinking the collapsible front portion and the remaining portion having a buoyant means of buoying up the remaining portion in the body of water;

a means for hoisting the collapsible front portion and a means for maintaining the collapsible front portion at the water level, so that the collapsible portion is alternately capable of sinking, pivoting downwardly at the hinge means, to allow the vessel to enter and exit the envelope, and alternately capable of being raised up to the water level by the means for hoisting and maintained at the water level by the means for retaining the collapsible front portion so that the envelope surrounds the vessel and protects the vessel from marine growth, wherein the means for hoisting the collapsible front portion and the means for maintaining the collapsible front portion at the water level comprises at least one block attached to the collapsible front portion and at least one block attached to the slip and a rope capable of being secured removably through the blocks and pulled for hoisting the collapsible front portion the rope further capable of being secured to the vessel for maintaining the collapsible front portion at the water level; and a means for securing the envelope to the slip.

2. The protector of claim 1 further comprising a rigid elongated element secured around the upper edge of the envelope to maintain the upper edge in a rigid shape.

3. The protector of claim 2 wherein the envelope is fabricated of a flexible sheet of water impervious material having a tubular opening around the upper edge and the elongated element comprises a series of interconnected pipe sections fabricated of a rigid waterproof material, the pipe sections being inserted and interconnected inside the tubular opening, the pipe sections in the collapsible front portion of the envelope having sufficient weight to form the weighted means to sink the collapsible front portion in water.

4. The protector of claim 3 wherein the elongated element comprises a series of interconnected sections of aluminum pipe.

5. The protector of claim 3 wherein the hinge means comprises a hinge connection between a section of pipe in the collapsible front portion of the envelope and a section of pipe in the remaining portion of the envelope.

6. The protector of claim 3 wherein the buoyant means comprises a series of floatation devices secured around the upper edge of the remaining portion of the envelope.

7. The protector of claim 1 wherein the means for securing the envelope to the slip comprises a series of blocks secured to the slip at various points and a series of ropes threaded through the blocks, each of the ropes secured at a proximal end to one of a number of points around the remaining portion of the envelope opposite to a block and secured at a distal end to a weight submerged in the water, so that the envelope is retained within the slip and the upper edge of the envelope is pulled outwardly away from the vessel.

8. A protector against marine growth for an underwater body of a vessel when moored in a body of water within the protector which may be positioned within a slip having a pier and pilings, the protector comprising:

an envelope of water impervious material secured to the slip, the envelope having an outer end facing out of the slip and an inner end facing into the slip and an upper edge at the waterline surrounding the vessel, the envelope being of a size and shape complementary to the underwater part of a vessels hull from its bow to its stem and from its keel to a position between its water line and its deck, the outer end having a collapsible front portion connected by a hinge means to a remaining portion of the envelope, the collapsible front portion having a weighted means for sinking the collapsible front portion and the remaining portion having a buoyant means of buoying up the remaining portion in the body of water;

a means for hoisting the collapsible front portion and a means for maintaining the collapsible front portion at the water level, so that the collapsible portion is alternately capable of sinking, pivoting downwardly at the hinge means, to allow the vessel to enter and exit the envelope, and alternately capable of being raised up to the water level by the means for hoisting and maintained at the water level by the means for retaining the collapsible front portion so that the envelope surrounds the vessel and protects the vessel from marine growth; and a means for securing the envelope to the slip, wherein the means for securing the envelope to the slip comprises a series of blocks secured to the slip at various points and a series of ropes threaded through the blocks, each of the ropes secured at a proximal end to one of a number of points around the remaining portion of the envelope opposite to a block and secured at a distal end to a weight submerged in the water, so that the envelope is retained within the slip and the upper edge of the envelope is pulled outwardly away from the vessel.

9. The protector of claim 8 wherein the means for hoisting the collapsible front portion and the means for maintaining the collapsible front portion at the water level comprises at least one block attached to the collapsible front portion and at least one block attached to the slip and a rope capable of being secured removably through the blocks and pulled for hoisting the collapsible front portion, the rope further capable of being secured to the vessel for maintaining the collapsible front portion at the water level.

10. The protector of claim 8 further comprising a rigid elongated element secured around the upper edge of the envelope to maintain the upper edge in a rigid shape.

11. The protector of claim 10 wherein the envelope is fabricated of a flexible sheet of water impervious material having a tubular opening around the upper edge and the elongated element comprises a series of interconnected pipe sections fabricated of a rigid waterproof material, the pipe sections being inserted and interconnected inside the tubular opening, the pipe sections in the collapsible front portion of the envelope having sufficient weight to form the weighted means to sink the collapsible front portion in water.

12. The protector of claim 11 wherein the elongated element comprises a series of interconnected sections of aluminum pipe.

13. The protector of claim 11 wherein the hinge means comprises a hinge connection between a section of pipe in the collapsible front portion of the envelope and a section of pipe in the remaining portion of the envelope.

14. The protector of claim 11 wherein the buoyant means comprises a series of floatation devices secured around the upper edge of the remaining portion of the envelope.

* * * * *